US007048158B2

(12) United States Patent
Hierzer

(10) Patent No.: US 7,048,158 B2
(45) **Date of Patent: *May 23, 2006**

(54) ELONGATED ORIFICE CLOSURE

(75) Inventor: Valentin Hierzer, Arlington Heights, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/780,760

(22) Filed: Feb. 9, 2001

(65) Prior Publication Data

US 2002/0108922 A1 Aug. 15, 2002

(51) Int. Cl.
*B65D 47/08* (2006.01)
*B65D 43/16* (2006.01)

(52) U.S. Cl. ..... 222/546; 220/847; 220/839; 222/556; 215/344; 215/343; 215/DIG. 1; 215/235

(58) Field of Classification Search ..... 222/556, 222/546, 212, 575; 215/321, 235, 354, 329, 215/232, 341, 343, 344, DIG. 1; 220/288, 220/836–839, 847
See application file for complete search history.

(56) References Cited

U.S. PATENT DOCUMENTS 3,240,405 A * 3/1966 Abbott ..... 222/543
4,605,136 A * 8/1986 Debetencourt ..... 215/232
4,767,016 A * 8/1988 Cook et al. ..... 215/232
4,793,501 A * 12/1988 Beck ..... 215/235
4,795,043 A * 1/1989 Odet et al. ..... 215/235
4,801,054 A * 1/1989 Nycz ..... 215/235
4,854,473 A * 8/1989 Dubach ..... 215/235
5,094,361 A * 3/1992 Dubach ..... 215/235
5,303,837 A * 4/1994 Adams et al. ..... 215/214
5,415,306 A * 5/1995 Luch et al. ..... 215/232
5,492,253 A * 2/1996 Proshan ..... 222/212
5,499,736 A * 3/1996 Kohl ..... 215/237
5,558,239 A * 9/1996 Dubach ..... 215/235
5,762,216 A * 6/1998 Takeuchi ..... 215/235
5,868,323 A 2/1999 Cantor
5,887,738 A * 3/1999 Bietzer et al. ..... 215/232

(Continued)

FOREIGN PATENT DOCUMENTS

CA 976113 10/1975

(Continued)

OTHER PUBLICATIONS

U.S. Appl. No. 10/068,714, as filed on Feb. 6, 2002.

(Continued)

*Primary Examiner*—Robin A. Hylton
(74) *Attorney, Agent, or Firm*—Woodcock Washburn LLP

(57) ABSTRACT

A closure and container package are provided in which the closure has an elongated orifice. A spout cover disposed on an underside surface of the cap portion of the closure receives a spout portion disposed about the orifice. A spud urges the spout into contact with the spout cover to enhance contact therebetween. A snap hinge couples the cap with the closure body. The spout cover forms a sealing contact with an exterior surface of the spout to form an outside seal that does not become contaminated upon dispensing of the contents of the container. The spout cover includes a protrusion or bead on an inner surface that cooperates with a bead on the spout exterior surface to lock the cap in its fully closed position. An annular seal extending downwardly from a portion of the closure seals the closure head-space to present vapor infiltration and condensation therein.

57 Claims, 4 Drawing Sheets

U.S. PATENT DOCUMENTS

| | | | | |
|---|---|---|---|---|
| 6,152,320 | A | 11/2000 | Hierzer et al. | |
| 6,152,324 | A * | 11/2000 | Baudin | 222/212 |
| 6,164,503 | A * | 12/2000 | Forsyth et al. | 215/232 |
| D436,040 | S * | 1/2001 | Warner et al. | D9/449 |
| 6,170,719 | B1 * | 1/2001 | Wilkinson et al. | 215/235 |
| 6,510,971 | B1 | 1/2003 | Martin | |
| 2002/0104855 | A1 | 8/2002 | DeGroot et al. | |

FOREIGN PATENT DOCUMENTS

| | | |
|---|---|---|
| FR | 2 752 820 | 3/1998 |
| WO | WO 01/96198 | 12/2001 |

OTHER PUBLICATIONS

Rosato, D.V. et al., "Injection Molding Handbook", *Kluwer Academic Publishers*, 2000, Chapter 8, 3rd Edition, 716-769.

* cited by examiner

ELONGATED ORIFICE CLOSURE

BACKGROUND

This invention relates to container closures, and more particularly to hinged container closures having an opening for dispensing material therethrough.

Several types of closures for sealing a container for holding and dispensing sauces and other contents are known. For example, a removable closure may be coupled to a container by threads disposed on a interior surface of the closure and mating threads disposed on an exterior surface of the container neck. Unscrewing the closure enables complete detachment of the closure from the container and easy dispensing from an opening in the container. The drawbacks of the fully-removable closure include potential loss or soiling of the closure while it is detached, the requirement of two hands to operate the closure, and a generally inconvenient opening process compared with some other closures. Further, in some circumstances, the container contents may adhere to the underside of the closure and eventually coat the threads, which is unattractive, unsanitary, and may inhibit the unscrewing process.

Another type of closure employs a cap that is hinged to a body such that the cap may be pivoted relative to the body. The body may be coupled to a container by threads disposed on an interior surface of the closure body and mating threads disposed on an exterior surface of the container neck. Some versions of the hinged closure include a deck covering the container opening except for a circular (in transverse cross section) pour or dispensing opening formed therein. A circular plug-formed on the underside of the cap is insertable into a spout that is formed proximate the pour opening upon closing of the cap relative to the body. Unfortunately, during normal operation the plug contacts the container contents that are disposed proximate the pour opening upon closing. Thus, residue of the material contents adhere to the plug and are visible on the plug upon pivoting the cap relative toward its open position, which is unattractive and difficult to clean.

Containers having a hinged cap often have a linear that is disposed over the container opening to form a seal therewith. Typically, the closure is tightened before the liner is sealed to the container rim by induction welding or like process. Unfortunately, the induction welding process tends to loosen the closure such that, in some circumstances, the torque required to unscrew the closure is below a desired value or near zero—that is, the closure is loose. Further, the container liquid or semi-solid contents, or water used to wash the threads or container, often adheres to the threads of the container and closure during the filling process. The loose closure enables evaporated liquid from the thread area or from the ambient atmosphere to condense within the closure and collect on top of the liner. Thus, an end user may encounter the condensed liquid upon removing the closure and before piercing or removing the liner, which is undesirable.

SUMMARY

A closure is provided that includes a spout projecting from a closure body and a sealing spout cover projecting form a hinged cap. The spout cover forms an outside seal with the spout. According to a first aspect of the present invention, a closure for resealably closing a container comprises a closure body, a cap, and a hinge.

The closure body includes a top deck; a skirt downwardly depending from a periphery of the top deck, the skirt including threads disposed thereon; an elongated orifice formed in the top deck, the elongated orifice defining a length that is greater than its width, and a spout extending upwardly from the top deck substantially coextensive with the orifice. The spout and top deck merging to form a concave radius on an upper side of the top deck. An underside of the lower deck forms a convex radius proximate the orifice and opposite the concave radius. The spout preferably includes a pair of opposing vertical sidewalls and a pair of opposing curved end walls. The sidewalls may be configured such that they outwardly bulge upon molding, yet are substantially mutually rectilinear and parallel upon cooling after molding. Such a configuration enables or promotes the ability to form a seal with the cap without a spud on the inside of the spout.

The cap includes a lid member, a cap sidewall extending downwardly from a periphery of the lid member, and a spout cover extending downwardly from the lid member. The spout cover includes a spout cover sealing surface on an interior surface thereof for receiving the spout therein. The spout cover sealing surface and a surface of the cap form a sealing contact therebetween while the cap is in a closed position, thereby forming an outside seal relative to the spout.

The hinge is coupled between the body and the cap for enabling actuation of the cap relative to the body between an open position in which the spout cover is disengaged with the spout and the closed position in which the spout cover is engaged with the spout. The orifice enables dispensing of container contents therethrough while the cap is in the open position and the spout cover prevents dispensing of the container contents while the cap is in the closed position. Further, the spout cover deflects outwardly relative to the spout while the cap is moved from the open position to the closed position, thereby forming an interference fit between the spout and the spout cover.

The present invention also encompasses a mold for forming such a closure.

DESCRIPTION OF A PREFERRED EMBODIMENT

Figure 1:
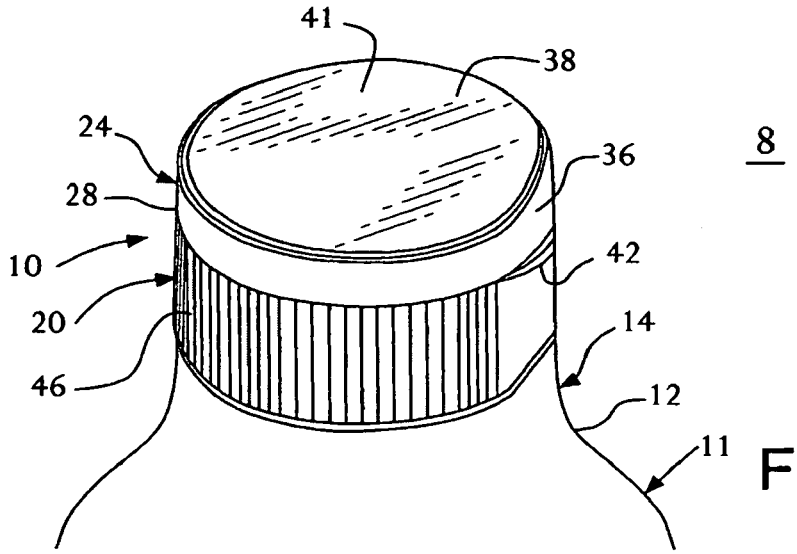
FIG. 1 illustrates a cross sectional view of closure according to the present invention disposed in an as-molded position.
Figure 6:
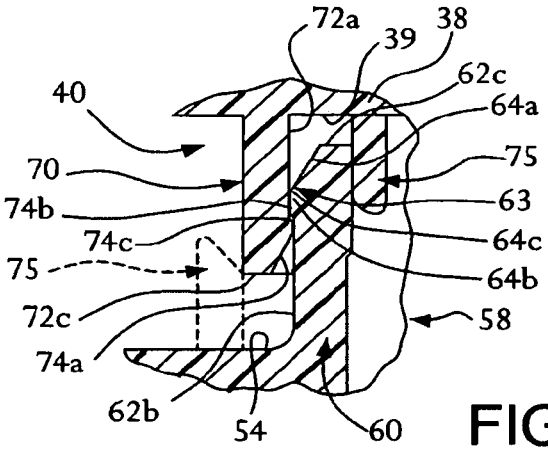
FIG. 6 is a view of the closure of FIG. 1 disposed in a fully closed position.

According to a first aspect of the present invention, a container package 8 includes a closure 10 that is coupled to a container 11. A preferred embodiment of closure 10 is shown in FIGS. 1 and 6, and container 11 is shown diagrammatically in FIG. 6. Container package 8 may be employed for packaging any contents capable of flowing, especially viscous materials such as jellies, sauces, pastes, granular materials, and like substances.

As shown in relief in FIG. 6, container 11 includes a container sidewall 12 having a neck 14 that extends upwardly to a lip 18. Container threads 16 are formed on an exterior surface of neck 14. A liner 19 may be disposed on lip 18 over the opening in neck 14 to seal the contents of container 11. Preferably, linear 19 is of the type that may be induction welded to lip 18, such as a plastic liner with a foil layer. The present invention also encompasses the container package 8 employing any liner material. Further, the container package 8 may employ liners of other designs, and may forego a linear altogether. Container 11 may be formed of any conventional material, including plastic and glass, and the present invention is especially suitable for plastic containers having flexible sidewalls that enable squeezing to urge the contents (not shown) to flow through the closure 10.

As shown in FIG. 1, closure 10 includes a body 20 that is coupled to container 11, a cap 24, and a hinge 28 coupled between body 20 and cap 24. Hinge 28 enables cap 24 to be repeatably pivoted relative to body 20. Body 20 includes a generally cylindrical skirt 30 and a substantially circular top deck 32 that preferably is integrally formed with an upper portion of skirt 30. Skirt 30 preferably includes plural serrations 46 disposed on an exterior surface thereof to enhance gripping of closure 10 by a user, as well as closure threads 48 disposed on an interior surface of skirt 30 that mate to threads 16 of container 11. The terms "interior" and "exterior"; "inward" and "outward"; and "inboard" and "outboard", as used herein, refer to relatively inwardly facing and relatively outwardly facing (relative to a longitudinal centerline of container 11 or other point of reference) directions or orientations, unless the direction or orientation is specified otherwise.

Deck 32 includes a deck top surface 54 and a deck bottom surface 56. As shown in FIGS. 1, 3, 4, and 7, an annular recess 52 is formed at a periphery of deck 32 and includes a shoulder portion 53*a* and a substantially flat seating surface 53*b*. Preferably, shoulder portion 53*a* and seating surface 53*b* are configured such that recess 52 is a notch, in longitudinal cross section. Thus, in longitudinal cross section, seating surface 53*b* is substantially horizontal and shoulder portion 53*a* may be substantially vertical to form an approximate cylinder, or may be angled slightly radially inwardly to form an approximate frustum of a cone. The present invention encompasses other configurations of the portion of deck 32 that interfaces with cap 24 in the closed position, as well be apparent to persons familiar with closure configurations.

Figure 2:
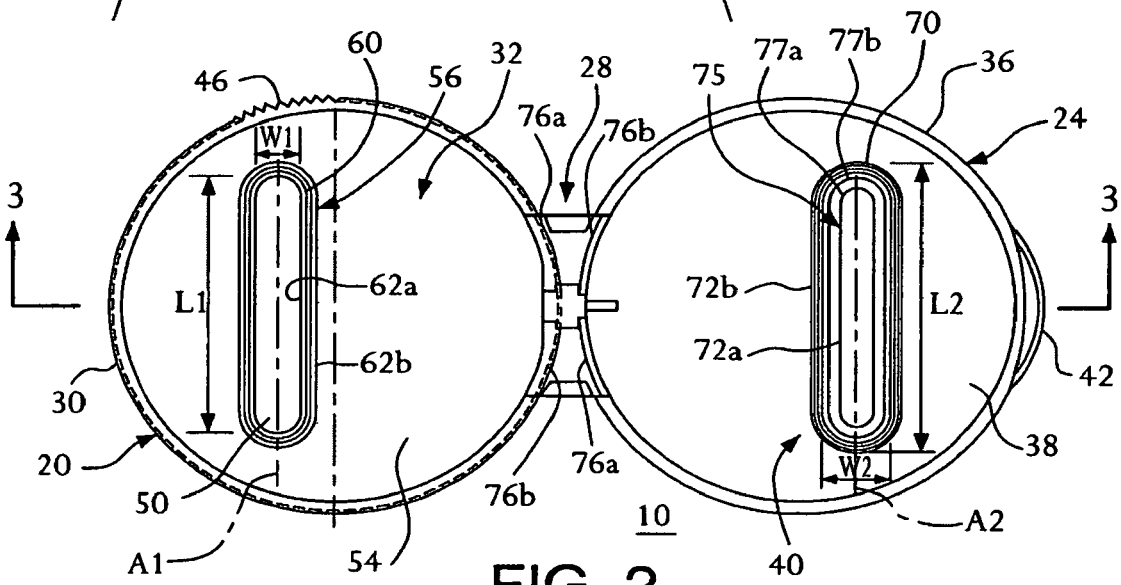
FIG. 2 is a top view of the closure shown in FIG. 1.
Figure 3:
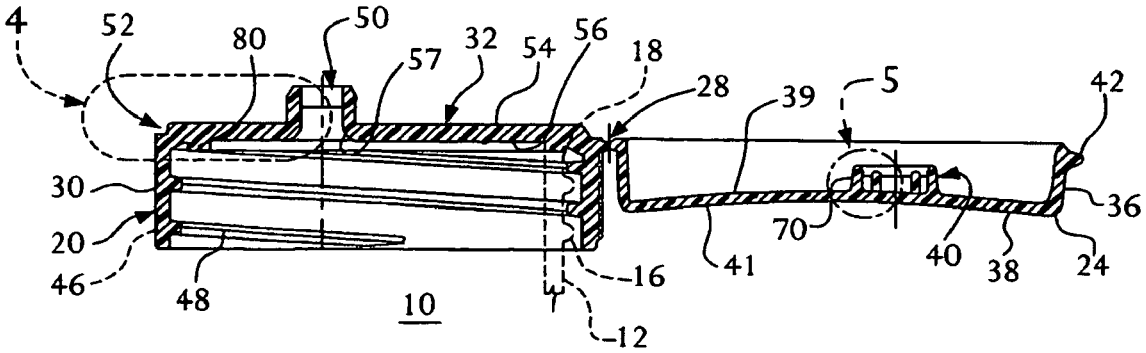
FIG. 3 is a cross sectional view taken through a portion of the closure indicated by lines 3—3 in FIG. 2, thereby providing a view of the inboard side of the spout.
Figure 4:
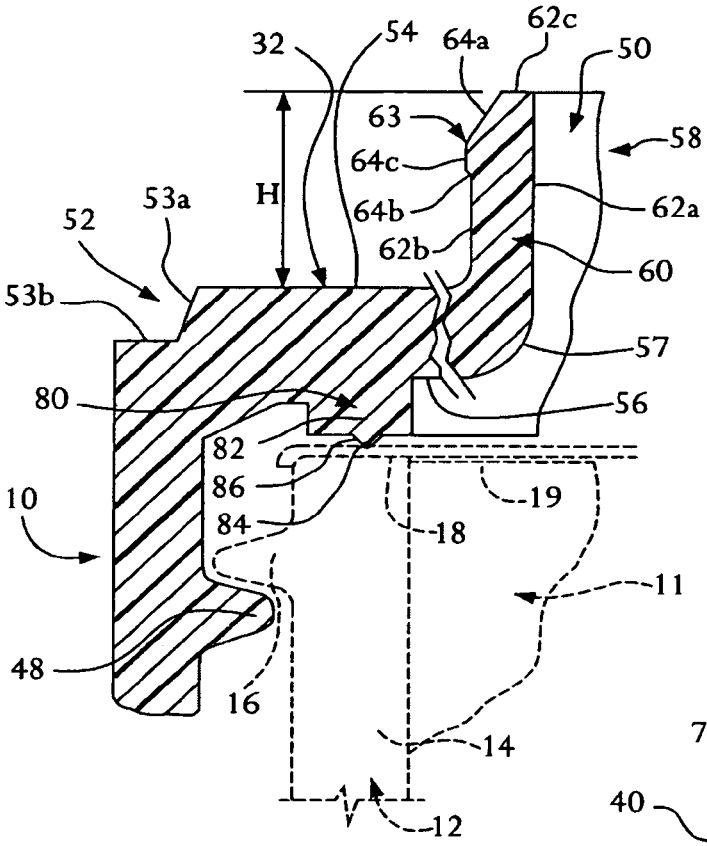
FIG. 4 is a cross sectional view taken through a portion of the closure indicated by lines 4—4 in FIG. 2, thereby providing a view of the outboard side of the spout.

An orifice 50 is formed through deck 32 between top surface 54 and bottom surface 56 to enable dispensing of the contents from an interior of container 11. As shown in FIGS. 2 and 3 (which are aligned for convenience of illustration), orifice 50 has a length L1, which is measured along its longitudinal axis A1, that is greater than its width W1, which is measured transverse to longitudinal axis QA1 at the widest point of orifice 50. Orifice 50 is shown in the figures as a slot having, in plan view as shown in FIG. 2, a pair of sidewalls with semi-circular or rounded ends. The present invention in not limited to such a configuration, and encompasses an orifice in the shape of an ellipse, oval, and the like. For dispensing jelly, or a similarly viscous product, from a container that is capable of being deformed by squeezing, the L1 and W1 dimensions are preferably about 1.0 inches (25.4 mm) and 0.2 (5 mm), respectively. An orifice having such dimensions may dispense the contents through orifice 50 in a ribbon approximately one inch wide.

A spout 58 extends upwardly from top surface 54 about orifice 50. Preferably, spout 58 has a pair of opposing long sides 60*a* and a pair of opposing curved ends 60*b* that extend around the entire perimeter or periphery of orifice 50. Preferably, opposing long sides 60*a* are substantially parallel or slightly outwardly bowed (relative to orifice longitudinal axis A1), as explained more fully below. The present invention also encompasses long sidewalls that are angled inwardly at the top or bottom of orifice 50 (which configuration is not shown) and therefore encompasses sidewalls that are not mutually parallel, and also encompasses side walls that are slightly inwardly bowed in plan view. Other wall configurations area also contemplated.

Deck top surface 54 smoothly merges into spout sidewall 60*a* to form a concave radius 57*a*. Deck bottom surface 56 smoothly extends upwardly to form a convex radius portion 57*b*, which smoothes the flow of product during dispensing. Preferably, the radii 57*a* and 57*b* may be approximately 0.09 and 0.13 inches, respectively, which have been found to provide adequate product flow characteristics. In this regard, because the radius of convex radius 57*b* on the underside is relatively large, concave radius 57*a* may have a similar profile to that of convex radius 57*b* in order to provide adequate wall thickness and efficient use of material.

Figure 7:
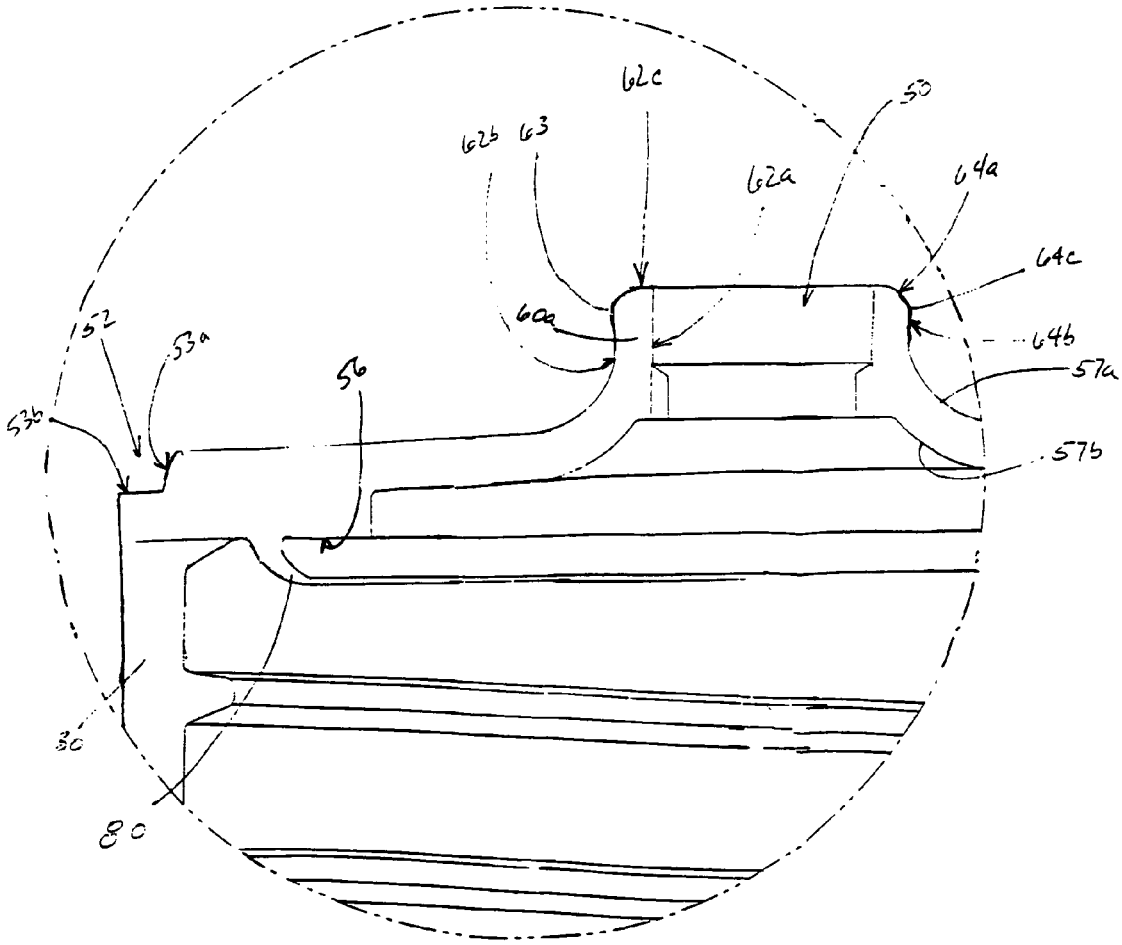
FIG. 7 is an enlarged view of a portion of the closure identified in the circle labeled by reference numeral 7 in FIG. 1.

As best shown in FIG. 7, spout sidewall 60 includes an interior surface 62*a*, an opposing exterior surface 62*b*, and a distal rim 62*c* therebetween. A protrusion or bead 63 extends radially outwardly from exterior surface 62*b*, and preferably extends entirely around the perimeter of spout sidewall 60 and orifice 50. Spout bead 63 may be formed of any geometry, and preferably is defined, in longitudinal cross section as shown in FIG. 7, by an upper surface 64*a*, an opposing lower surface 64*b*, and a distal tip 64*c* disposed between surfaces 64*a* and 64*b*.

Preferably, spout bead surfaces 64*a*, 64*b*, and 64*c* form smooth contours without sharp edges or transitions. In this regard, tip 64*c* may be (in longitudinal cross section) a rounded portion below a substantially flat, inclined (relative to the sidewalls of surfaces 62*a* or 62*b*) upper surface 64*a* such that rounded tip portion 64*c* smoothly yields to upper surface 64*a*. Further, lower surface 64*b* preferably is short compared to upper surface 64*a* such that tip 64*c* smoothly merges with the sidewall of exterior surface 62*b*. The present invention is not limited to the contours described herein, but rather encompasses any spout bead contours or any sealing means, even a spout that altogether lacks protrusions or beads like those describe herein, as will be understood by persons familiar with closure and sealing technology. For example, surfaces 64*a*, 64*b*, and 64*c* may define a continuously curved or bulbous protrusions or bead. The present invention also encompasses a spout that lacks a protruding bead, as well as a discontinuous bead.

As shown in FIGS. 1 and 2, cap 24 includes a substantially cylindrical sidewall 36 and a substantially circular lid member 38 that is integrally formed with an upper end of sidewall 36. Lid member 38 has an underside 39 and an opposing top side 41. The terms "underside" and "top", as used herein with respect to cap 24, refer to the orientation with cap 24 in its closed position shown in FIG. 6. Cap 24 is inverted from its position shown in FIGS. 1 and 2 to form its closed position. In this regard, a spout cover 40 extends upwardly form an underside of lid member 38. The present invention also encompasses closures that are non-cylindrical, including those having elliptical, irregular, or other shapes.

Figure 8:
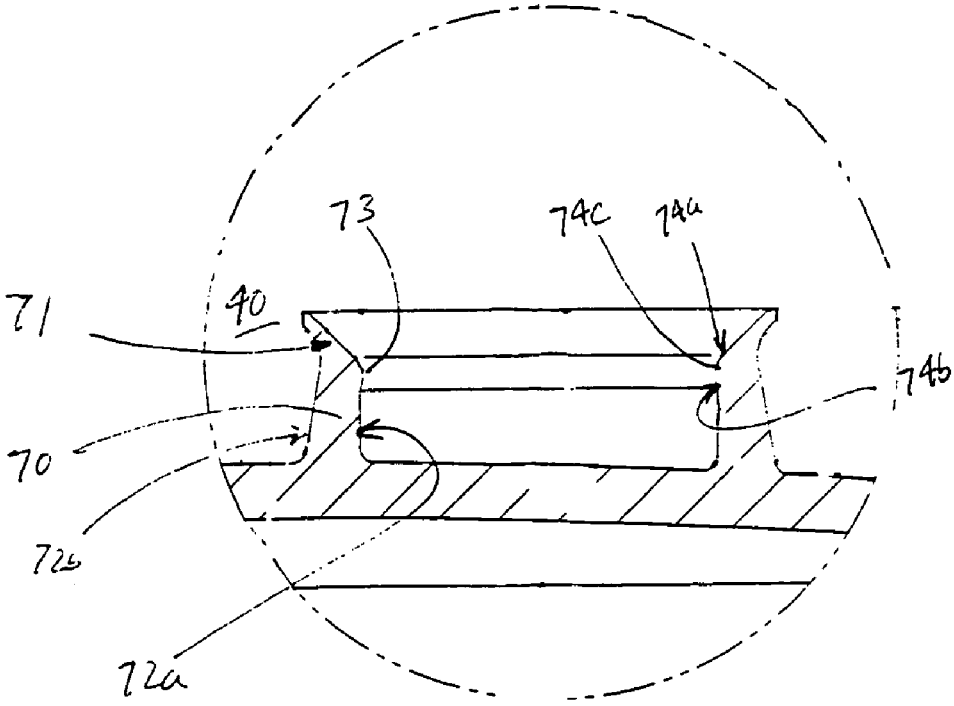
FIG. 8 is an enlarged view of a portion of the closure identified in the circle labeled by reference number 8 in FIG. 1.

As best shown in FIG. 8, spout cover 40 is formed by a cover sidewall 70 having an interior surface 72*a*, and an opposing exterior surface 76*b*. Cover sidewall 70 also has an outwardly protruding lip 71 disposed between surfaces 72*a* and 72*b*. A cover protrusion or bead 73 extends radially inwardly, relative to spout cover 40, from interior surface 72*a*, and preferably extends entirely around the perimeter of spout cover sidewall 70. Spout cover 40 preferably is configured to fit over and outside of spout 58, as described more fully below. Thus, spout cover 40 may have an internal length dimensions L2 along its longitudinal axis A2 that is approximately equal to orifice length L1 plus twice the width of spout sidewall 60, and an internal width dimension W2 that is approximately equal to orifice width W1 plus twice the thickness of spout sidewall 60.

Spout bead 73 may be formed of any geometry, and preferably is defined, in cross section, by an upper surface 74*a*, an opposing lower surface 74*b*, and a distal tip 74*c* disposed between surfaces 74*a* and 74*b*. In this regard, tip 74*c* may be, in longitudinal cross section as shown in FIG. 8, a rounded portion below a substantially flat, inclined (relative to the sidewalls of surfaces 72*a* or 72*b*) upper surface 74*a* such that rounded tip portion 74*c* smoothly yields to upper surface 74*a*, and such that upper surface 74*a* forms a portion of distal lip 71. The present invention is not limited to the contours described herein, but rather encompasses any spout cover bead contours or any sealing means, a discontinuous bead, and even a spout cover that altogether lacks beads like those described herein, as will be understood by persons familiar with closure and sealing technology. For example, surfaces 74*a*, 74*b*, and 74*c* may define a continuously curved or bulbous protrusion or bead.

Hinge 28 includes a first end 76*a* that is integrally coupled with skirt 30 and an opposing second end 76*b* that is integrally coupled with cap 24. Preferably, hinge 28 is a flexible web that forms a snap hinge, as disclosed in U.S. Pat. No. 6,152,320, which is assigned to the assignee of the present invention and incorporated herein by reference in its entirety. The present invention is not limited to snap hinges, but rather encompasses any hinge disposed between cap 24 and body 20.

FIG. 6 illustrates the closure 10 in a closed position in which cap 24 is engaged with body 20. In the closed position, a portion of cap sidewall 36 is disposed in the recess 52 formed by shoulder portion 53*a* and seating surface 53*b*. Preferably, the internal radius of the cap sidewall 36 is several thousands of an inch larger than the radius of shoulder portion 53*a* to enable cap 24 to slide into and out of recess 52. Preferably, a distal rim or tip of cap sidewall 63 contacts seating surface 53*b* in the fully closed position.

Further, spout cover 40 is disposed over and around spout 58 to form a seal therewith while cap 24 is in its fully closed position. As explained more fully below, because long sidewalls are (in plan view or in transverse cross section) substantially parallel (even after shrinking upon cooing after molding) or slightly outwardly bowed, spout cover 40 forms a seal with spout 58. For example, a seal may be provided by sealing contact between sealing surfaces 62*b* and 72*a*, which is described more fully below. Preferably, each one of spout 58 and spout cover 40 are continuous and coextensive. That is, the overall shape (in transverse cross section) and size of spout sidewall exterior surface 62*b* are substantially the same as the shape and size of cover sidewall interior surface 72*a*. Thus, spout 58 fits within spout cover 40 and forms sealing contact therebetween.

As shown in FIG. 6, while cap 24 is in the fully closed position, spout cover 40 is engaged with spout 58 to form the sealing contact therebetween such that cover bead 73, and particularly cover bead tip 74*c*, contacts spout sidewall exterior surface 62*b* and such that spout bead 63, and particularly spout bead tip 64*c* contacts cover sidewall interior surface 72*a*. In this regard, spout 58 and spout cover 40 are preferably molded such that there is contact between tip 74*c* and surface 62*b* and between tip 64*c* and surface 72*a* such that deflection of spout 58 and/or spout cover 40 occurs during closing and, preferably, also while closure 10 is in the fully closed position. FIG. 6 indicates such deflection by illustrating body 20 and cap 24 in their fully open shape, which results in overlapping surfaces at the interface between spout 58 and spout cover 40.

Closure 10 may be configured to require a predetermined opening force, which preferably is in the range of 1 to 7 pounds (0.45 to 3.2 kg), depending on the design parameters and preferences of the designer. The opening force may be determined by the configuration, dimensions, and/or location of beads 63 and 73, sidewalls 60 and 70, orifice 50, and like features, as will be understood by persons familiar with closure technology. Thus, the sealing contact between spout 58 and spout cover 40 (among other features) provides the combination of an effective seal around orifice 50 and an opening force within the desired range.

Hinge 28, while the closure is in the fully closed position, may provide a small force urging cap 24 toward the open position to bias cover bead lower surface 74*b* toward and against spout bead lower surface 64*b*. The contacts between tip 74*c* and surface 62*b* and between tip 64*c* and surface 72*a*, and preferably also bead surfaces 64*b* and 74*b*, preferably are continuous around the entire periphery of spout 58. However, the present invention encompasses discontinuous sealing contact.

Thus, according to an aspect of the present invention, the sealing contact between spout 58 and spout cover 40 forms an outside seal (that is, disposed on the exterior surface of the spout sidewall 60) that is spaced apart from the rim 62*c* of spout 58. In this regard, during normal dispensing of the material contents from container 11 through orifice 50, the material contents do not come into contact with the sealing contact area that is defined between the spout exterior surface 62*b* and the spout cover sidewall 72*b*. Therefore, during normal dispensing of the contents from the container package, the sealing contact between the spout 58 and the spout cover 40 is spaced apart from the contents and does not become sullied thereby.

Further, lip 71 may also aid in the centering of cap 24 relative to spout 58 during the closing process. The outwardly extending configuration of lip 71 may also wire product from the area proximate spout rim 62*c* without exposing spout cover outer sidewall 72*b* to the product.

Figure 5:
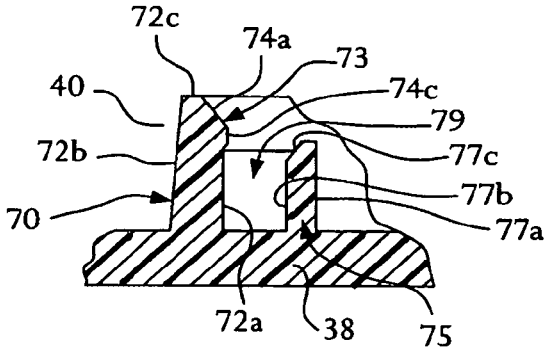
FIG. 5 is a cross sectional view taken through a portion of the closure indicated by lines 5—5 in FIG. 2.

According to another aspect of the present invention, as shown in FIGS. 3 and 5, an annular closure seal 80 is formed on an underside of deck 32 such that a body 82 of seal 80 protrudes downwardly from deck bottom surface 56. As best shown in FIG. 5, closure seal 80 includes a flexible lip or crab claw, which preferably is continuous to form an unbroken circle in transverse cross section. Seal 80 may prevent liquid in the thread area form splashing onto the top surface of liner 19 or from running onto the top surface of liner 19 upon inversion of container package 8 or upon washing.

Further seal 80 may prevent or inhibit water vapor from entering the head-space, which is above the liner 19 and below deck 32, and condensing therein. Also, the sealing contact between spout 58 and spout cover 40 also inhibits water vapor from entering the head-space. Thus, seal 80 and the sealing contact between spout 58 and spout cover 40 substantially eliminate or diminish the problem of water condensation on the top of liner 19.

To open container package 8, a user may grasp container neck 14 with cap 24 in the closed position, as shown in FIG. 6, in which tip 74*c* and surface 62*b*, and tip 64*c* and surface 72*a* are in contact. The user may urge upwardly on a thumbpiece (preferably disposed opposite hinge 28) of a cap 24 to urge cover bead lower surface 74*b* against spout bead lower surface 64*b*. Each of the surfaces 64*b* and 74*b* are rounded or inclined to facilitate mutual sliding in response to upward urging of a thumb tab (not shown in the Figures) or like portion of cap 24 until cover bead tip 74*c* slips upward past spout bead tip 64*c*. Cap 24 continues to rotate relative to body 20 by continued urging of cap 24 and/or by the action of snap hinge 28 until it reaches its rest-open position, which is likely to be less than 180 degrees from its fully closed position, depending to the configuration of hinge 28. The position of cap 24 relative to body 20 shown in FIGS. 1 and 2 is the position in which closure 10 is molded, and may not represent the rest-open position of cap 24.

Upon cap 24 being disposed in its rest-open position, the user may invert container package 8 to dispense the material contents through orifice 50. For containers with flexible sidewalls, the user may squeeze the container sidewalls to urge the material contents through orifice 50. The elongated shape of orifice 50 provides greater open area through which material contents may pass.

The user may urge cap 24 toward deck 32 to pivot closure 10 from its open position toward its closed position. Hinge 28 may also urge cap 24 toward its closed position upon reaching its snap action point. The orifice being spaced apart from a center of deck 32, as best shown in FIG. 2, enables spout cover 40 to clear spout 58 during pivoting about hinge 28. Alternatively, a hinge may be provided that enables spout cover 40 to clear spout 58, and the respective heights and location of cover 40 and spout 58 may be chosen accordingly. To move cap 24 into its fully closed position, the user may cap 24 downwardly such that the distal rim of cap sidewall 36 moves past the rounded portion of shoulder portion 53*a*. Further, spout cover lip 71 (which is the leading surface of spout cover 40 because cap 24 is in an inverted from its molded state during closing) may contact spout bead upper surface 64*a* to relatively align the parts and/or to wipe product contents (if any) from the top area of spout 58 inwardly toward orifice 50.

A user applies force downwardly on cap 24 such that cover bead upper surface 74*a* slides relative to spout bead upper surface 64*a*. Spout cover sidewall 70 and/or spout sidewall 60 deform or deflect relative to one another until cover bead tip 74*c* is urged downwardly past spout bead tip 64*c*. As cover bead lower surface 64*b* comes into contact with spout bead lower surface 74*b* such that cap 24 reaches its fully closed position, a distal rim of cap sidewall 36 may contact seating surface 53*b*.

According to another aspect of the present invention, a mold 90 has a cavity with surfaces configured for forming closure 10. Mold 90 is indicated diagrammatically in FIG. 1 by a dashed line. The precise gate location, split line, and other parameters relating to molding are conventional and will be understood by persons familiar with molding technology. The present invention encompasses molding of closure 10 in mold 90 by any conventional technique, such as injection molding, compression molding, and the like.

As referred to above, sidewalls 60*a* spout 40 will have a tendency to pull inwardly when its material cools and shrinks after molding. Thus, mold 90 includes cavity surfaces that are slightly outwardly bowed. Thus, because spout 58 (that is the mold surface corresponding to spout 58, as well as the spout 58 of closure 10 immediately upon molding) has a width W1 proximate its midpoint that is greater than a width proximate its ends, cooling or shrinkage may result in substantially parallel spout sidewalls 60*a*. Depending on the particular configuration, size, wall thickness (and like parameters), spout 58 preferably may be a few thousandths of an inch wider at its center (that is, W1) than at its ends. Similarly, the mold cavity surfaces may be configured such that sidewalls 60*a* have a slight bow after cooling and shrinkage in order to enhance the contact between spout 58 and spout cover 40.

Embodiments of the closure, mold, and container assembly disclosed herein have been employed to illustrate aspects of the present invention. The scope of the present invention, however, is not limited to the particular embodiments discussed herein, but rather encompasses other embodiments that will be apparent to persons familiar with closure technology in view of the present disclosure. For example, the present invention encompasses closures that are coupled to the container integrally or by a snap feature, as distinguished from the threads shown in the figures, closures that are oval or otherwise noncircular in transverse cross section, closures having hinges that are different from that described herein, or those entirely foregoing hinges, and the like. Further, co-pending U.S. patent application No. 09/780,760, entitled, "Elongated Closure Orifice," which is a incorporated herein by reference in its entirety, provides additional details of components that may be employed with the present invention. Thus, the scope of the invention may be ascertained by reference to the claims.

What is claimed is:

1. A closure for resealably closing a container, the closure comprising:

a closure body including a top deck, a skirt downwardly depending from a periphery of the top deck, an elongated orifice formed in the top deck, and a spout extending upwardly from the top deck substantially coextensive with the orifice, the skirt including threads disposed thereon, the elongated orifice including a length that is greater than its width, the orifice is spaced apart from a longitudinal centerline of the closure;

a cap including a lid member, a cap sidewall extending downwardly from a periphery of the lid member, a spud, and a spout cover extending downwardly from the lid member, an interior surface of the spout cover receiving the spout therein, the spout cover interior surface and an exterior surface of the spout forming a sealing contact therebetween while the cap is in a closed position thereby forming an outside seal relative to the spout, the spud extending downwardly from the lid member substantially within the spout cover and spaced apart therefrom, an exterior surface of the spud contacting an interior surface of the spout while the closure is in the closed position, the contact between the spud and the interior surface of the spout enhances the sealing contact between the spout cover interior surface and the spout exterior surface, the spout cover has a height measured from the lid member that is greater than a height of the spout such that a distal edge of the spout cover extends below a distal tip of the spud while the closure is in its closed position; and a hinge coupled between the body and the cap for enabling actuation of the cap relative to the body between an open position in which the spout cover is disengaged with the spout and the closed position in which the spout cover is engaged with the spout, whereby the orifice enables dispensing of container contents therethrough while the cap is the open position and the spout cover prevents dispensing of the container contents while the cap is in the closed position.

2. The closure of claim 1 further comprising a continuous, annular seal extending downwardly from an underside of the deck, whereby the annular seal and the sealing contact between the spout and the spout cover inhibit vapor infiltration into a head-space within the closure.

3. The closure of claim 1 wherein the spud is elongate and continuous.

4. A closure for resealably closing a container, the closure comprising:

a closure body including a top deck, a skirt downwardly depending from a periphery of the top deck, an elongated orifice formed in the top deck, and a spout extending upwardly from the top deck substantially coextensive with the orifice, the skirt including threads disposed thereon the elongated orifice including a length that is greater than its width;

a cap including a lid member, a cap sidewall extending downwardly from a periphery of the lid member, a spud, and a spout cover extending downwardly from the lid member, an interior surface of the spout cover receiving the spout therein, the spout cover interior surface and an exterior surface of the spout forming a sealing contact therebetween while the cap is in a closed position thereby forming an outside seal relative to the spout, the spud extending downwardly from the lid member substantially within the spout cover and spaced apart therefrom, an exterior surface of the spud contacting an interior surface of the spout while the closure is in the closed position, the contact between the spud and the interior surface of the spout enhances the sealing contact between the spout cover interior surface and the spout exterior surface the spout cover has a height measured from the lid member that is greater than a height of the spud such that a distal edge of the spout cover extends below a distal tip of the spud while the closure is in its closed position, the spout cover includes a spout cover bead extending inwardly from the spout cover interior surface, the spout cover bead engaging the spout exterior surface to form sealing contact therebetween while the cap is in the closed position; and a hinge coupled between the body and the cap for enabling actuation of the cap relative to the body between an open position in which the spout cover is disengaged with the spout and the closed position in which the spout cover is engaged with the spout, whereby the orifice enables dispensing of container contents therethrough while the cap is the open position and the spout cover prevents dispensing of the container contents while the cap is in the closed position.

5. A closure for resealably closing a container, the closure comprising:

a closuring body including a top deck, a skirt downwardly depending from a periphery of the top deck, an elongated orifice formed in the top deck, and a spout extending upwardly from the top deck substantially coextensive with the orifice, the skirt including threads disposed thereon, the elongated orifice including a length that is greater than its width;

a cap including a lid member, a cap sidewall extending downwardly from a periphery of the lid member, a spud, and a spout cover extending downwardly from the lid member, an interior surface of the spout cover receiving the spout therein, the spout cover interior surface and an exterior surface of the spout forming a sealing contact therebetween while the cap is in a closed position thereby forming an outside seal relative to the spout, the spud extending downwardly from the lid member substantially within the spout cover and spaced apart therefrom, an exterior surface of the spud contacting an interior surface of the spout while the closure is in the closed position, the contact between the spud and the interior surface of the spout enhances the sealing contact between the spout cover interior surface and the spout exterior surface, the spout cover has a height measured from the lid member that is greater than a height of the spud such that a distal edge of the spout cover extends below a distal tip of the spud while the closure is in its closed position, the spout includes a spout bead extending outwardly from the spout exterior surface, the spout bead engaging the spout cover interior surface to form sealing contact therebetween while the cap is in the closed position; and a hinge coupled between the body and the cap for enabling actuation of the cap relative to the body between an open position in which the spout cover is disengaged with the spout and the closed position in which the spout cover is engaged with the spout, whereby the orifice enables dispensing of container contents therethrough while the cap is the open position and the spout cover prevents dispensing of the container contents while the cap is in the closed position.

6. A closure for resealably closing a container, the closure comprising:

a closure body including a top deck, a skirt downwardly depending from a periphery of the top deck, an elongated orifice formed in the top deck, and a spout extending upwardly from the top deck substantially coextensive with the orifice, the skirt including threads disposed thereon, the elongated orifice including a length that is greater than its width;

a cap including a lid member, a cap sidewall extending downwardly from a periphery of the lid member, a spud, and the spout cover extending downwardly from the lid member, an interior surface of the spout cover receiving the spout therein, the spout cover interior surface and an exterior surface of the spout forming a sealing contact therebetween while the cap is in a closed position thereby forming an outside seal relative to the spout, the spud extending downwardly from the lid member substantially within the spout cover and spaced apart therefrom, an exterior surface of the spud contacting an interior surface of the spout while the closure is in the closed position, the contact between the spud and the interior surface of the spout enhances the sealing contact between the spout cover interior surface and the spout exterior surface, the spout cover has a height measured from the lid member that is greater than a height of the spud such that a distal edge of the spout cover extends below a distal tip of the spud while the closure is in its closed position, the spout cover includes a spout cover bead extending inwardly from the spout cover interior surface and a spout bead extending outwardly from the spout exterior surface, the spout cover bead engaging the spout exterior surface and the spout bead engaging the spout cover interior surface to form sealing contact therebetween while the cap is in the closed position; and a hinge coupled between the body and the cap for enabling actuation of the cap relative to the body between an open position in which the spout cover is disengaged with the spout and the closed position in which the spout cover is engaged with the spout, whereby the orifice enables dispensing of container contents therethrough while the cap is the open position and the spout cover prevents dispensing of the container contents while the cap is in the closed position.

7. The closure of claim 6 wherein the spout cover bead includes an upper surface, a lower surface, and a tip therebetween, and the spout bead includes an upper surface, a lower surface, and a tip therebetween, the spout cover bead tip contacting the spout exterior surface and the spout bead tip contacting the spout cover interior surface while the cap is in the closed position.

8. The closure of claim 7 wherein the spout cover bead upper surface contacts the spout bead lower surface while the cap is in the closed position such that the spout cover is locked onto the spout.

9. The closure of claim 6 wherein the spout is continuous about the orifice.

10. The closure of claim 9 wherein the spout cover is continuous about the spout while the cap is in the closed position.

11. The closure of claim 10 wherein the spout bead is continuous about the spout and the spout cover bead is continuous about the spout cover.

12. The closure of claim 1 wherein the cap further includes a thumb tab extending outwardly from the sidewall.

13. The closure of claim 1 wherein the top deck is substantially circular and the skirt is substantially cylindrical.

14. The closure of claim 1 wherein the hinge includes a flexible web including a first end coupled to the skirt and an opposing second end coupled to the cap sidewall, the web capable of urging the cap toward either one of the open position or the closed position, whereby the hinge is a snap action hinge.

15. The closure of claim 6 wherein the body includes an annular recess formed at a periphery of the top deck, the annular recess including a seating surface, a distal lip of the cap sidewall contacting the seating surface upon the spout cover bead engaging the spout bead to form sealing contact therebetween while the cap is in the closed position.

16. The closure of claim 1 wherein the orifice is a slot including substantially parallel opposing sides and curved ends therebetween.

17. A container package including:

a container including a container body, a neck disposed on the container body, and container threads formed on an exterior surface of the neck; and a closure for resealably closing the container, the closure comprising:

a closure body including a top deck, a skirt downwardly depending from a periphery of the top deck, an elongated orifice formed in the top deck, and a spout extending upwardly from the top deck substantially coextensive with the orifice, the skirt including closure threads disposed thereon, the elongated orifice including a length that is greater than its width, the orifice is spaced apart from a longitudinal centerline of the closure;

a cap including a lid member, a cap sidewall extending downwardly from a periphery of the lid member, a spud, and a spout cover extending downwardly from a periphery of the lid member, a spud, and a spout cover extending downwardly from the lid member, an interior surface of the spout cover receiving the spout therein, the spout cover interior surface and an exterior surface of the spout forming a sealing contact therebetween while the cap is in a closed position thereby forming an outside seal relative to the spout, the spud extending downwardly from the lid member substantially within the spout cover and spaced apart therefrom, an exterior surface of the spud contacting an interior surface of the spout while the closure is in the closed position, the sealing contact between the spout cover interior surface and the spout exterior surface is enhanced by the contact between the spud and the spout, the spout cover has a height measured from the lid member that is greater than a height of the spud such that a distal edge of the spout cover extends below a distal tip of the spud while the closure is in its closed position; and a hinge coupled between the body and the cap for enabling actuation of the cap relative to the body between an open position in which the spout cover is disengaged with the spout and the closed position in which the spout cover is engaged with the spout, whereby the orifice enables dispensing of container contents therethrough while the cap is the open position and the spout cover prevents dispensing of the container contents while the cap is in the closed position.

18. The container package of claim 17 further comprising a liner disposed between a rim of the container neck and the closure body and a continuous, annular seal extending downwardly from an underside of the deck, the annular seal forming a seal between the liner and the closure body.

19. The container package of claim 17 wherein the annular seal includes a projection including an angular tip formed thereon that deforms a portion of the liner.

20. The container package of claim 17 wherein the spud is elongate and continuous.

21. The closure of claim 1 further comprising an other spud extending upwardly from the top deck substantially around the spout and spaced apart therefrom, an interior surface of the other spud contacting an exterior surface of the spout cover while the closure is in the closed position, whereby the sealing contact between the spout cover interior surface and the spout exterior surface is enhanced.

22. The closure of claim 21 wherein the other spud is elongate and continuous.

23. The container package of claim 17 further comprising an other spud extending upwardly from the top deck substantially around the spout and spaced apart therefrom, an interior surface of the spud contacting an exterior surface of the spout cover while the closure is in the closed position, whereby the sealing contact between the spout cover interior surface and the spout exterior surface is enhanced.

24. The container package of claim 23 wherein the other spud is elongated and continuous.

25. The closure of claim 1 wherein the spout cover includes a spout cover bead extending inwardly from the spout cover interior surface, the spout cover bead engaging the spout exterior surface to form sealing contact therebetween while the cap is in the closed position.

26. The closure of claim 1 wherein the spout includes a spout bead extending outwardly from the spout exterior surface, the spout bead engaging the spout cover interior surface to form sealing contact therebetween while the cap is in the closed position.

27. The closure of claim 1 wherein the spout cover includes a spout cover bead extending inwardly from the spout cover interior surface and a spout bead extending outwardly from the spout exterior surface, the spout cover bead engaging the spout exterior surface and the spout bead engaging the spout cover interior surface to form sealing contact therebetween while the cap is in the closed position.

28. The closure of claim 27 wherein the spout cover bead includes an upper surface, a lower surface, and a tip therebetween, and the spout bead includes an upper surface, a lower surface, and a tip therebetween, the spout cover bead tip contacting the spout exterior surface and the spout bead tip contacting the spout cover interior surface while the cap is in the closed position.

29. The closure of claim 28 wherein the spout cover bead upper surface contacts the spout bead lower surface while the cap is in the closed position such that the spout cove is locked onto the spout.

30. The closure of claim 27 wherein the spout is continuous about the orifice.

31. The closure of claim 30, wherein the spout cover is continuous about the spout while the cap is in the closed position.

32. The closure of claim 31 wherein the spout bead is continuous about the spout and the spout cover bead is continuous about the spout cover.

33. The closure of claim 1 wherein the body includes an annular recess formed at a periphery of the top deck, the annular recess including a seating surface, a distal lip of the cap sidewall contacting the seating surface upon the spout cover bead engaging the spout bead to form sealing contact therebetween while the cap is in the closed position.

34. The closure of claim 4 further comprising a continuous, annular seal extending downwardly from an underside of the deck, whereby the annular seal and the sealing contact between the spout and the spout cover inhibit vapor infiltration into a head-space within the closure.

35. The closure of claim 4 wherein the spud is elongate and continuous.

36. The closure of claim 4 further comprising an other spud extending upwardly from the top deck substantially around the spout and spaced apart therefrom, an interior surface of the other spud contacting an exterior surface of the spout cover while the closure is in the closed position, whereby the sealing contact between the spout cover interior surface and the spout exterior surface is enhanced.

37. The closure of claim 36 wherein the other spud is elongate and continuous.

38. The closure of claim 4 wherein the cap further includes a thumb tab extending outwardly from the sidewall.

39. The closure of claim 4 wherein the top deck is substantially circular and the skirt is substantially cylindrical.

40. The closure of claim 4 wherein the hinge includes a flexible web including a first end coupled to the skirt and an opposing second end coupled to the cap sidewall, the web capable of urging the cap toward either one of the open position or the closed position, whereby the hinge is a snap action hinge.

41. The closure of claim 4 wherein the orifice is a slot including substantially parallel opposing sides and curved ends therebetween.

42. The closure of claim 5 further comprising a continuous, annular seal extending downwardly from an underside of the deck, whereby the annular seal and the sealing contact between the spout ad the spout cover inhibit vapor infiltration into a head-space with the closure.

43. The closure of claim 5 wherein the spud is elongate and continuous.

44. The closure of claim 5 further comprising an other spud extending upwardly from the top deck substantially around the spout and spaced apart therefrom, an interior surface of the other spud contacting an exterior surface of the spout cover while the closure is in the closed position, whereby the sealing contact between the spout cover interior surface and the spout exterior surface is enhanced.

45. The closure of claim 44 wherein the other spud is elongate and continuous.

46. The closure of claim 5 wherein the cap further includes a thumb tab extending outwardly from the sidewall.

47. The closure of claim 5 wherein the top deck is substantially circular and the skirt is substantially cylindrical.

48. The closure of claim 5 wherein the hinge includes a flexible web including a first end coupled to the skirt and an opposing second end coupled to the cap sidewall, the web capable of urging the cap toward either one of the open position or the closed position, whereby the hinge is a snap action hinge.

49. The closure of claim 5 wherein the orifice is a slot including substantially parallel opposing sides and curved ends therebetween.

50. The closure of claim 6 further comprising a continuous, annular seal extending downwardly from an underside of the deck, whereby the annular seal and the sealing contact between the spout and the spout cover inhibit vapor infiltration into a head-space within the closure.

51. The closure of claim 5 wherein the spud is elongate and continuous.

52. The closure of claim 5 further comprising an other spud extending upwardly from the top deck substantially around the spout and spaced apart therefrom, an interior surface of the other spud contacting an exterior surface of the spout cover while the closure is in the closed position, whereby the scaling contact between the spout cover interior surface and the spout exterior surface is enhanced.

53. The closure of claim 52 wherein the other spud is elongate and continuous.

54. The closure of claim 5 wherein the cap further includes a thumb tab extending outwardly from the sidewall.

55. The closure of claim 5 wherein the top deck is substantially circular and the skirt is substantially cylindrical.

56. The closure of claim 5 wherein the hinge includes a flexible web including a first end coupled to the skirt and an opposing second end coupled to the cap sidewall, the web capable of urging the cap toward either one of the open position or the closed position, whereby the hinge is a snap action hinge.

57. The closure of claim 5 wherein the orifice is a slot including substantially parallel opposing sides and curved ends therebetween.

* * * * *